US007001089B2

(12) United States Patent
Tozaki et al.

(10) Patent No.: US 7,001,089 B2
(45) Date of Patent: Feb. 21, 2006

(54) THERMAL PRINTER

(75) Inventors: Shuji Tozaki, Chiba (JP); Noriyoshi Shoji, Chiba (JP); Katsuari Sato, Chiba (JP); Kimitaka Hirai, Chiba (JP)

(73) Assignee: Seiko Instruments Inc., Chiba (JP)

( * ) Notice: Subject to any disclaimer, the term of this patent is extended or adjusted under 35 U.S.C. 154(b) by 0 days.

(21) Appl. No.: 10/787,732

(22) Filed: Feb. 26, 2004

(65) Prior Publication Data

US 2004/0234314 A1 Nov. 25, 2004

(30) Foreign Application Priority Data

May 23, 2003 (JP) ..... 2003-145849

(51) Int. Cl.
*B41J 29/18* (2006.01)

(52) U.S. Cl. ..... 400/708; 400/706; 400/693; 347/222

(58) Field of Classification Search ..... 400/621, 400/708, 706, 692, 693; 347/222
See application file for complete search history.

(56) References Cited

U.S. PATENT DOCUMENTS 4,674,895 A * 6/1987 Tanaka et al. ..... 400/323
4,896,166 A * 1/1990 Barker et al. ..... 347/197
5,030,968 A * 7/1991 Benson et al. ..... 347/222
5,092,698 A * 3/1992 Narui et al. ..... 400/649
5,168,287 A * 12/1992 Okunomiya et al. ..... 347/220
5,296,874 A * 3/1994 Nagata et al. ..... 347/218
5,396,396 A 3/1995 Watanabe ..... 361/212
5,570,962 A 11/1996 Suzuki et al. ..... 400/120.16
5,579,043 A * 11/1996 Patry ..... 347/222
5,820,068 A * 10/1998 Hosomi et al. ..... 242/563
5,833,380 A * 11/1998 Hosomi et al. ..... 400/621
6,019,532 A 2/2000 Harris et al. ..... 400/708
6,118,469 A 9/2000 Hosomi ..... 347/222

FOREIGN PATENT DOCUMENTS

EP 1145861 10/2001

* cited by examiner

*Primary Examiner*—Andrew H. Hirshfeld
*Assistant Examiner*—Marissa Ferguson
(74) *Attorney, Agent, or Firm*—Adams & Wilks

(57) ABSTRACT

A thermal printer has a main body frame and a platen roller rotatably and removably mounted in a preselected position on the main body frame. A thermal head is mounted on the main body frame for movement into and out of pressure contact with the platen roller during a printing operation and while the platen roller is in the preselected position for recording printing data on a recording medium disposed between the thermal head and the platen roller. A detecting device detects a preselected state of the thermal printer in which the platen roller is in the preselected position and in which the recording medium is disposed between the platen roller and the thermal head.

3 Claims, 7 Drawing Sheets

THERMAL PRINTER

BACKGROUND OF THE INVENTION

1. Field of the Invention

The present invention relates to a thermal printer which performs printing on recording paper passed between a platen roller and a print head, and which is effective for detection of the presence or absence of the recording paper and detection of a set state of the print head.

2. Description of the Related Art

A thermal printer provided with a thermal head having a heating element and a platen roller is used in a cash register that prints and outputs receipts, a ticket dispenser that dispenses tickets by printing the tickets on recording paper, and the like.

Generally, such a thermal printer performs paper feed while performing printing by pressing the platen roller against the thermal head and rotating the platen roller. Here, there are broadly three kinds of systems for setting recording paper in the thermal printer: a manual feed system where the print head is set separated from the platen roller and the recording paper is manually inserted between the print head and the platen roller; an automatic insertion system where when the recording paper is inserted between the print head and the platen roller, a sensor detects this situation and the platen roller automatically makes rotation and pulls in the recording paper; and a platen attachment/detachment system where the platen roller is detached, the recording paper is loaded, and the platen roller is attached again. Regardless of which one of these systems is adopted, the conventional thermal printer is basically provided with two kinds of sensors, one of which is used to detect the presence or absence of the recording paper and the other of which is used to detect whether the head and the platen roller are set at their predetermined positions.

The reason why the two sensors are provided in this manner is that in the thermal printer, print information is transmitted from a control circuit side to the print head and the head heating element is heated in accordance with the print information, so that if printing is performed under a state where the recording paper does not exist or the platen roller does not contact the head, this results in a situation where print processing is carried out without performing precise printing on the recording paper and the print information is lost.

Also, if the head heating element is continuously driven and heated under a state where the platen roller is separated from the print head, heat is not conducted from the head heating element to the recording paper and stays in the head heating element. Under this state, the head heating element is heated to a high temperature as compared with a state where the print head is pressed against the platen roller, which results in a problem that the head heating element is significantly damaged and its durability is decreased.

Further, in the case where the head heating element is driven and heated under a state where the recording paper does not exist, when the platen roller is pressed against the print head, the platen roller is directly headed. This results in a situation where the platen roller is significantly damaged.

As a conventional technique of solving these problems, there is known a thermal printer provided with a lock detection sensor, such as a mechanical switch, which detects the open/close state of a cover with respect to a printer main body, and a recording paper detection sensor, such as a photointerrupter, which utilizes reflection light, thereby making it possible to detect the presence or absence of the recording paper and the lock/unlock state with reliability when the recording paper is set in the printer and the cover of the printer main body is closed (see Patent Document 1, for instance).

Also, as another conventional technique, there is known a thermal printer where only one photosensor, such as photointerrupter, which utilizes reflection light is provided and, when recording paper is set in the printer but a platen roller is not set at its predetermined position, the photosensor is prevented from being turned on by pushing up the recording paper using a wire spring (see Patent Document 2, for instance).

[Patent Document 1]

JP 2000-46322 A

[Patent Document 2]

JP 2000-46321 A

With the invention disclosed in Patent Document 1 described above, however, the detection of the presence or absence of the recording paper and the detection of the position of the platen roller with respect to the head are performed using the two sensors. Therefore, the number of components is increased, and a control unit that monitors states of these two sensors becomes necessary, which leads to a problem that a control mechanism becomes complicated and increase in costs becomes inevitable. Also, the presence or absence of the recording paper is detected using an optical sensor such as a photosensor, so that there is a possibility that the sensor may malfunction due to scattered light entering from the outside.

Also, with the invention disclosed in Patent Document 2 described above, an urging member, such as a wire spring, which sets the recording paper spaced apart from a paper guide, needs to be provided for the paper guide in addition to the photosensor applied to the recording paper detection, which makes the structure complicated. Also, in order to release the wire spring from a stressed state in an interlocked manner with the opening of the cover and to set the recording paper spaced apart from the paper guide with reliability, it is required to position and dispose the wire spring with high precision, which results in a problem that assembling work becomes cumbersome and a detection mechanism becomes complicated.

SUMMARY OF THE INVENTION

The present invention has been made in order to solve the problems described above, and aims at providing a thermal printer which performs detection of the presence or absence of recording paper and detection of the position of a platen roller with respect to a head with reliability using only one sensor, and which has such a simple structure that it can be diverted to any one of the manual feed system, the automatic insertion system, and the platen attachment/detachment system described above merely by changing some components.

In order to solve the above-mentioned problems, a thermal printer according to the present invention includes: a main body frame; a thermal head for performing printing on recording paper and a head supporting member integrally provided at the back of the thermal head; a platen roller placed side by side with the thermal head; a bearing portion for rotatably and attachably/detachably supporting the platen roller; an urging means for urging the thermal head in a direction in which the thermal head is brought into pressure contact with the platen roller; and a load detection type sensor provided at a position at which under a state where the recording paper exists below the platen roller and a shaft of the platen roller is supported by the bearing portion, the load detection type sensor is capable of being brought into pressure contact with the platen roller through the recording paper and changing into an ON state.

Here, the load detection type sensor is provided on the upper surface of a paper guide plane, facilitating insertion of the recording paper, pulled out from roll paper between the thermal head and the platen roller. Also, the load detection type sensor is arranged at a position at which the load detection type sensor is capable of contacting the outer periphery of the platen roller through the recording paper in the case where the platen roller is attached to the main body frame. Although a detailed description will be given in the following embodiments, a hole having a predetermined shape may be provided in the upper surface of the paper guide plane and the load detection type sensor may be arranged in the hole, for instance.

Also, the load detection type sensor is provided with an elastic member inside thereof and an elastic force of the elastic member is set so that the elastic member is deformed in defiance of its elastic force by a total sum of a load of the recording paper and a pressing force exerted on the upper surface of the recording paper from start of the attachment of the platen roller to the main body frame to completion of the attachment. As the elastic member, a pressurizing spring such as a wire spring or a plate spring, a material having elasticity such as a molded sheet, a structural member produced to achieve elasticity by combining multiple kinds of members, and the like are conceivable, for instance.

When detecting the total sum of the load of the recording paper and the pressing force generated when the platen roller is completely attached to the main body frame, the load detection type sensor set in the printer transmits a signal indicating that the current state is an ON state to a control portion of the thermal printer.

Further, the thermal printer according to the present invention may further include a moving means for releasing the shaft of the platen roller supported by the bearing portion and moving the shaft of the platen roller in a direction in which the shaft is separated from the load detection type sensor.

The moving means may be composed of an actuation member that detaches the shaft of the platen roller from the bearing portion. For instance, a construction is conceivable in which the platen roller is provided for an upper cover serving as the actuation member and the shaft of the platen roller is detached from the bearing portion merely by rotating the upper cover and pulling up the shaft of the platen roller attached to the upper cover in a direction in which it is separated from the bearing portion. Also, it is possible to easily detach the shaft of the platen roller from the bearing portion, so that it becomes possible to construct the moving member only by using an actuation member having a simple structure and to reduce the number of components, which makes it possible to miniaturize the enclosure itself of the thermal printer. As a result, it becomes possible to reduce the volume of an information device itself equipped with the thermal printer, which contributes to miniaturization of the information device.

On the other hand, in a case where the thermal printer of the present invention employs one of a manual feed system and an automatic insertion system, other than a platen attachment/detachment system, the thermal printer may be structured such that the moving means includes: a cam abutted against the head supporting member, for moving the head supporting member in a direction in which the head supporting member is separated from the platen roller; and a lever for pivotally moving the cam.

Also, by integrating the platen roller and the head supporting member as a unit using the moving member, there may be realized a construction where end portions of the platen roller are not completely detached from the thermal printer main body. With this construction, it becomes possible to reduce a chance that, for instance, the detached platen roller will be lost or the end portions of the platen roller will be damaged at the time of attachment/detachment of the platen roller through an operation with user's fingers.

Further, the thermal printer according to the present invention may be structured such that the load detection type sensor detects a displacement of a load and performs ON/OFF switching when a load value exists in a range of 0.1 to 0.4 N (newton).

With this construction, it becomes possible to control the load detection type sensor so as not to detect the ON state only with the self-weight of the recording paper. As the load detection type sensor, it is possible to use any sensors so long as it is possible to detect loads in the range described above. For instance, a load detection type sensor provided for a flip of a mobile telephone and used to detect the open/close state of the mobile telephone may be used.

Also, by constructing the length of a spring in the load detection type sensor as adjustable, for instance, a range may be given to the, actuation load of the sensor. With this construction, it becomes possible to achieve a thermal printer that is capable of appropriately coping with various environmental changes such as changes in the thickness or stiffness of recording paper used and seasonal changes in the diameter of the platen roller.

Further, the thermal printer according to the present invention may be structured such that the load detection type sensor detects a stroke distance and performs ON/OFF switching when the stroke distance is in a range of 0.2 to 1 mm.

With this construction, ON/OFF switching is performed with reference to a stroke distance, so that it becomes possible to easily grasp in advance the range of the thickness of printable recording paper and the range of the composition, such as the diameter and expansion coefficient, of a usable platen roller and to easily make design changes as appropriate in accordance with usage environments. Also, it is possible to give a range to the actuation load by setting upper limit value and the lower limit value of the actuation load of the load detection type sensor at 1 mm and 0.2 mm, respectively. As a result, it becomes possible to realize a thermal printer that can appropriately cope with various environmental changes such as changes in the characteristics of recording paper used and changes in the diameter of the platen roller.

Further, the thermal printer according to the present invention may be structured such that the load detection type sensor is provided at a position closer to the shaft of the platen roller than an intersecting position between a vertical plane contacting an outer periphery of the platen roller and a paper guide plane under a state where the platen roller is supported by the bearing portion.

With this construction, the load detection type sensor can be disposed at a position in proximity to the platen roller. As a result, even if the recording paper pulled out from roll paper is misaligned or warped to some extent before being nipped between the thermal head and the platen roller, when the recording paper exists between the thermal head and the platen roller and the platen roller is attached to the main body frame, it is possible to detect the ON state.

BRIEF DESCRIPTION OF THE DRAWINGS

For a more better understanding of the present invention, reference is made of a detailed description to be read in conjunction with the accompanying drawings, in which.

DETAILED DESCRIPTION OF THE PREFERRED EMBODIMENTS

[First Embodiment]

Figure 1:
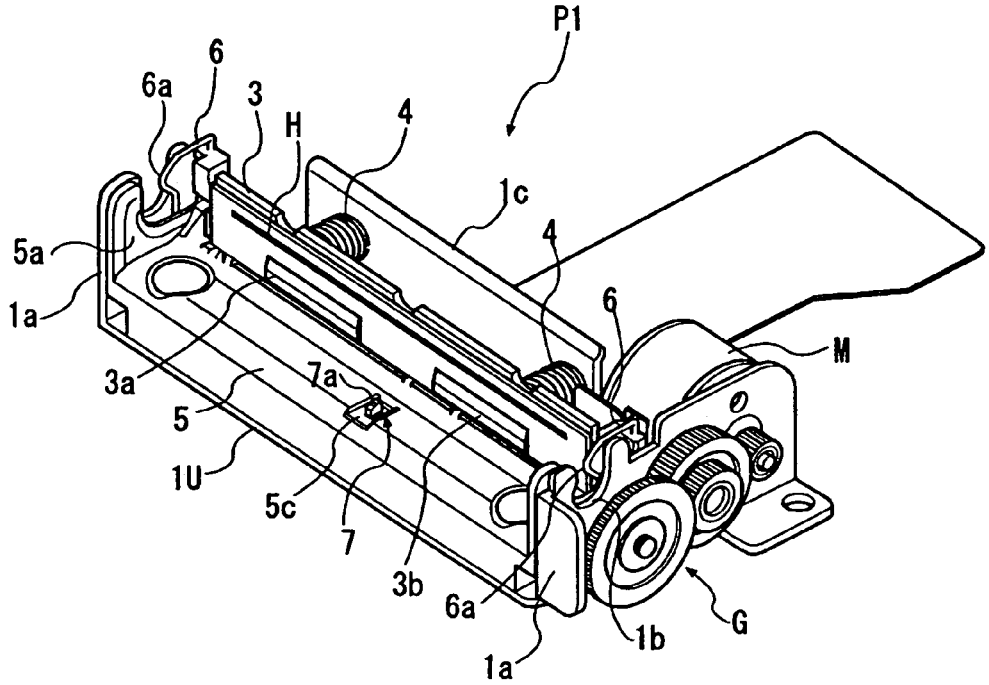
FIG. 1 is a perspective view showing a construction of a thermal printer according to an embodiment of the present invention.
Figure 2:
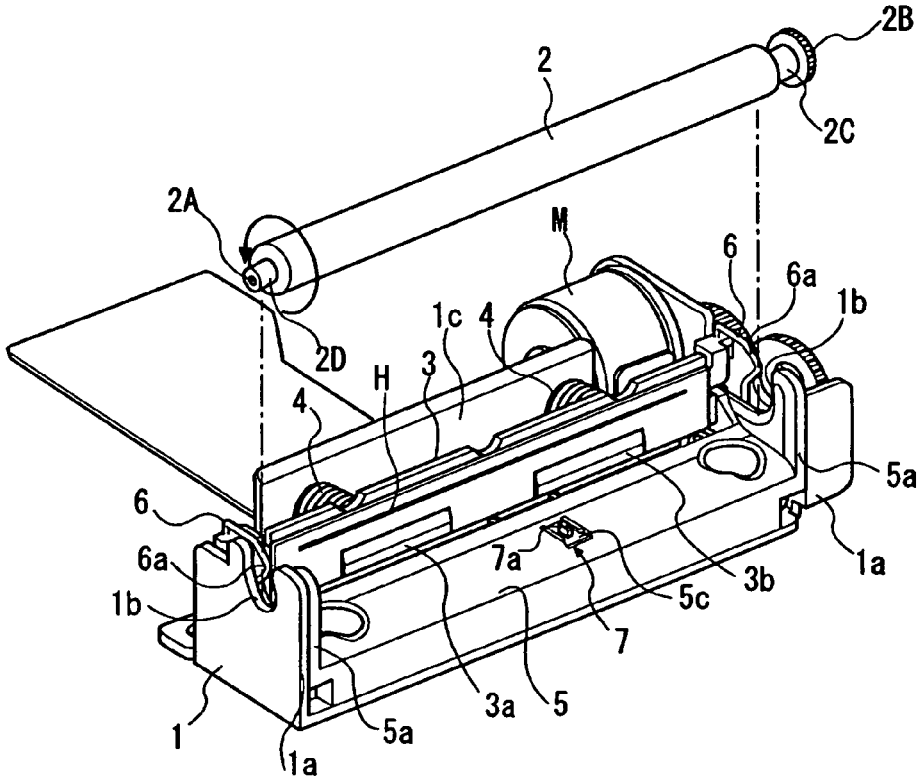
FIG. 2 is a perspective view of the thermal printer shown in FIG. 1 viewed from a different direction.

FIGS. 1 and 2 are each a perspective view showing an embodiment of a thermal printer P1 according to the present invention.

As shown in FIGS. 1 and 2, the thermal printer P1 is composed of a frame 1 having one pair of side wall portions 1*a* and 1*a* arranged so as to oppose each other with a predetermined distance therebetween in the paper width direction, a support member or head supporting member 3 that supports a thermal head H having a number of heating devices, one pair of compression springs 4 and 4 constituting urging or biasing means for biasing the thermal head H into pressing contact with a platen member in the form of a platen roller 2 via the head supporting member 3, a paper guide 5 made of a plastic, a motor N serving as a drive source, a gear transmission mechanism G that transmits a rotation drive force of the motor M to and driven gear 2B fixed to one end portion 2C of the platen roller 2, and the like.

The frame 1 is provided with a standing wall 1*c* bent so as to be positioned at the back of the head supporting member 3 and the springs 4 and 4 are inserted between the standing wall 1*c* and the head supporting member 3. In the side wall portions 1*a* and 1*a* of the frame 1, concave surfaces 1*b* and 1*b*, defining a bearing portion, are formed for engagement with both end portions 2C and 2D of a rotation shaft 2A of the platen roller 2 and for rotationally supporting the platen roller 2. Also, in both side portions of the paper guide 5, paper guide walls 5*a* and 5*a* for guiding a recording medium such as recording paper are provided adjacent to the concave surfaces 1*b* and 1*b*. Further, wire hooks 6 and 6, which serve as holding members for preventing the end portions of the platen roller 2 from coming out of engagement with the concave surfaces 1*b* and 1*b*, are provided between the paper guide walls 5*a* and 5*a* and the side wall portions 1*a* and 1*a*. The end portions 20 and 2D of the platen roller 2 are latched by the hooks 6 and 6 and the concave surfaces 1*b* and 1*b* of the side wall portions 1*a* and 1*a* of the frame 1.

Figure 3:
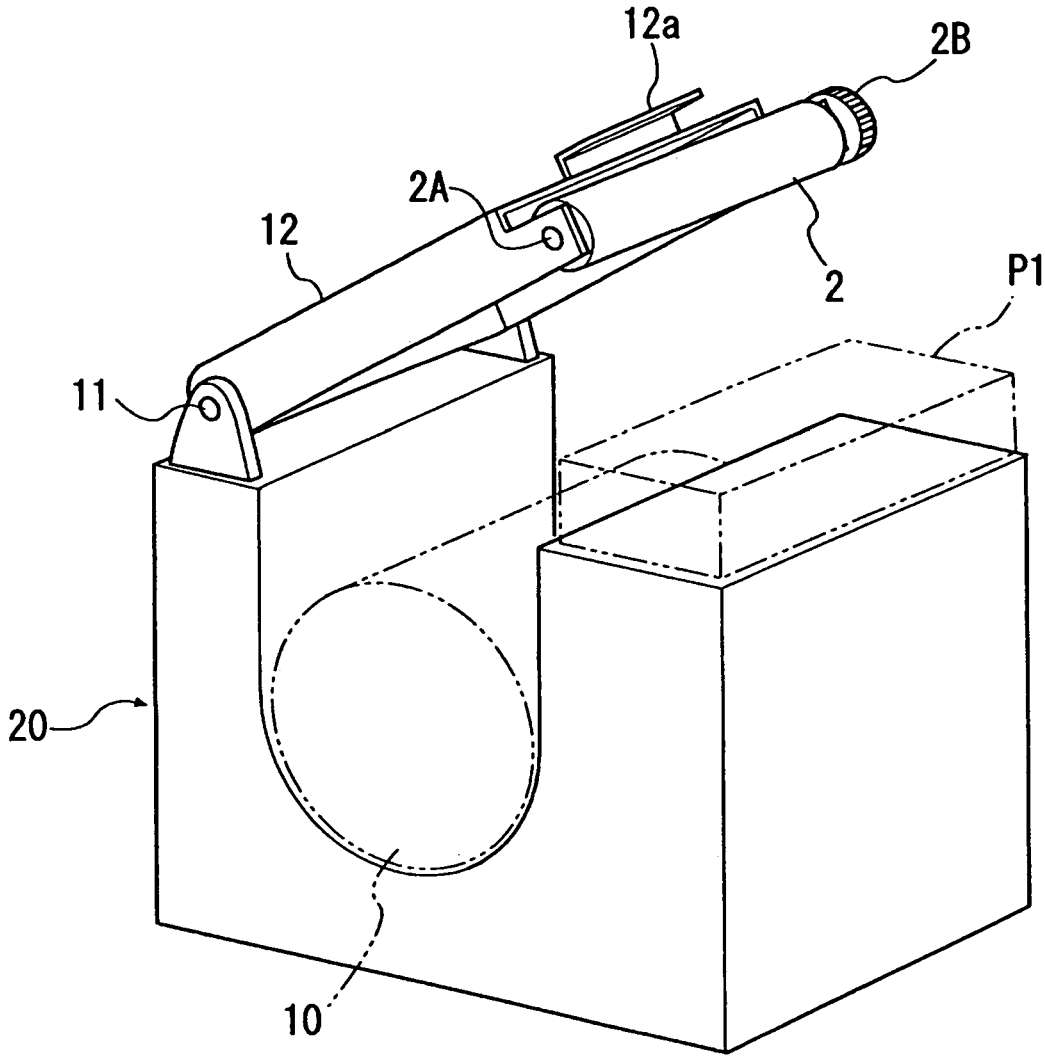
FIG. 3 is a perspective view showing an example of an information device equipped with the thermal printer shown in FIG. 1.

The hooks 6 and 6 include curved portions 6*a* that protrude to the inside of the concave surfaces 1*b* and 1*b*, and these curved portions 6*a* contact the end portions of the platen roller 2 from the above to prevent their detachment from the concave surfaces 1*b* and 1*b*. Each of the hooks 6 and 6 is connected to the head supporting member 3 at one end and is urged by indirectly utilizing an urging force of the compression springs 4. Also, a load detection type sensor 7 composed of a mechanical switch is provided in substantially the center of the upper surface of the paper guide 5. As shown in FIG. 3, for example, the platen roller 2 is rotatably attached to a forward end portion of an upper cover 12 pivoted to a recording paper containing portion 20 about a pin shaft 11. When the platen roller 2 is moved in a direction in which it gets closer to a load detection type sensor 7. constituting detecting means, from above through rotation of the upper cover 12 so that the end portions of the shaft of the platen engage with the concave surfaces 1*b* and 1*b*, the surfaces of the end portions of the platen roller 2 are abutted against the hooks 6 and 6, causing these hooks to be deformed and retracted from the concave surfaces 1*b* and 1*b*. Thus, the hooks are dislodged, allowing the platen roller 2 to move downwardly as it is to be fitted in the concave surfaces 1*b* and 1*b*.

Also, when it is desired to upwardly detach the platen roller 2, an operation piece 12*a* provided so as to protrude to the outside from the forward end portion of the upper cover 12 is pulled up with fingers. Then, the hooks 6 and 6 are deformed while sliding on the surfaces of the end portions of the platen roller 2. Following this, the hooks 6 and 6 move to below the end portions of the platen roller 2, and the hooks 6 and 6 push up the end portions of the platen roller 2 by means of their restoration forces, causing the platen roller end portions to be disengaged from the concave surfaces 1*b* and 1*b*. The hooks 6 and 6 are fixed to the head supporting member 3 as described above, so that when the hooks 6 and 6 are pressed, the compression springs 4 provided at the back of the head supporting member 3 are compressed, which facilitates the movement of the hooks 6 and 6 to below the end portions of the platen roller 2. By detaching the platen roller 2 in this manner, it becomes easy to set recording paper.

The paper guide 5 disposed between the side wall portions 1*a* and 1*a* is attached above a bottom plate portion 1U of the frame 1. The upper surface of the paper guide 5 is formed so as to be smoothly rounded. Also, a rectangular attachment hole 5*c* is formed in substantially the center of the paper guide 5 and the load detection type sensor 7 composed of a mechanical switch is attached inside the attachment hole 5*c*.

The load detection type sensor 7 includes an elastic member and a contact that becomes a conductive state when a load is placed from above in defiance of an elastic force of the elastic member. It is possible to select and change the elastic member as appropriate in accordance with usage environments of the thermal printer. For instance, it is possible to use a pressurizing spring such as a wire spring or a plate spring, a material having elasticity such as a molded sheet, a structural member adapted to exhibit elasticity by combining multiple kinds of members, and the like. When the platen roller 2 presses a movable protrusion portion or displaceable portion 7*a* of the load detection type sensor 7 through recording paper 10, the protrusion portion 7*a* moves downwardly in defiance of the elastic force of the not-shown elastic member of the load detection type sensor 7. Thus, the load detection type sensor 7 is changed from an OFF state to an ON state.

It should be noted here that the load detection type sensor detects a displacement of a load and performs ON/OFF switching when a load value is in a predetermined range. Also, by changing the predetermined range of the load value as appropriate, it is possible to appropriately adapt the thermal printer to various environmental changes such as changes in the thickness of the recording paper and changes in the sectional area of the platen roller resulting from changes in the temperature. In this embodiment, for instance, a setting is made such that the ON/OFF switching is performed when the load value is in a range of, for example, 0.1 to 0.4 N, thereby realizing an operation environment under which the recording paper is prevented from being damaged and no large torque is required for paper feed. This load value range of 0.1 to 0.4 N provides remarkable effects in that detection accuracy is enhanced and the operation environment described above is favorably realized. Also, by setting the lower limit value of an actuation load at 0.1 N, the load detection type sensor is controlled so as not to detect the ON state only with the self-weight of the recording paper. Further, any load detection type sensor may be used so long as it is possible to detect loads in the range described above. For instance, a load detection type sensor provided for a flip of a mobile telephone and used to detect the on/off state of the mobile telephone and used to detect the on/off state of the mobile telephone or the like may be used as it is.

It should be noted here that the load detection type sensor may be a sensor having a mechanism for detaching a stroke distance and providing the ON/OFF switching when the detected stroke distance is in a predetermined range. In this case, in this embodiment, a stroke distance in a range of 0.2 to 1 mm provides remarkable effects in that the detection accuracy is enhanced and the operation environment described above is favorably realized. With this construction, the ON/OFF switching is performed according to the stroke distance, so that it becomes possible to easily grasp in advance the range of the thickness of printable recording paper and the range of the composition, such as the diameter and expansion coefficient, of a usable platen roller. As a result, it becomes possible to easily make design changes as appropriate in accordance with usage environments.

When the load detection type sensor 7 is thus fully pressed downward in defiance of a resistance force, a sensor in the load detection type sensor 7 detects this and transmits a load detection signal to a control circuit. On receiving this signal from the sensor, the control circuit judges that the recording paper 10 exists and the platen roller 2 is attached to the frame 1, and transmits a drive start signal to a motor driver 43. Then, the motor M is driven, the platen roller 2 starts rotation, and printing is started as the thermal head H is heated in accordance with print information.

Molded portions 3*a* and 3*b* produced by molding a drive circuit IC of the thermal head H by using a resin are provided on a surface of the head supporting member 3 and protect the IC from faults such as a breakdown due to contact with sliding recording paper.

Next, a mechanism for detecting an attachment/detachment state as to whether the platen roller 2 is attached to the concave surfaces 1*b* and 1*b* of the side wall portions la and la of the thermal printer and detecting the presence or absence of the recording paper 10 by using the load detection type sensor 7 will be described with reference to FIGS. 4A–4C which are cross-sectional views showing the attachment/detachment states of the platen roller 2 and the states of the recording paper 10 in the thermal printer P1.

First, under a state where the platen roller 2 is detached, no load is placed on the mechanical load detection type sensor 7, so that the mechanical load detection type sensor 7 is set in an OFF state. Next, under a state where the platen roller 2 is detached, a leading end portion of the recording paper 10 wound like a roll is pulled out to a position where at least a region above the load detection type sensor 7 of the paper guide 5 of the printer main body is covered with the recording paper 10 (FIG. 4C). Under this state, the platen roller 2 is detached and only the recording paper exists on the load detection type sensor 7, so that only a load of the recording paper is placed on the load detection type sensor 7. The elastic force of the elastic member of the load detection type sensor 7 is set at a value greater than the load of the recording paper, so that the protrusion portion 7*a* of the load detection type sensor 7 cannot be pressed downward under this state. As a result, the load detection type sensor of the load detection type sensor 7 remains in the OFF state.

Next, the platen roller 2 is pressed against the concave surfaces 1*b* and 1*b* of the side wall portions 1*a* and 1*a* of the printer main body. As a result, the platen roller 2 is brought into pressure contact with the head supporting member 3 and bearings of the platen roller 2 are inserted into the concave surfaces 1*b* and 1*b* of the side wall portions 1*a* and 1*a,* causing the bearings of the platen roller to be fitted to the concave surfaces 1*b* and 1*b*. When the platen roller 2 is completely attached to the concave surfaces 1*b* and 1*b* in this manner, the platen roller 2 is brought into pressure contact with the recording paper 10 by means of an urging force from the thermal head H under a state where the recording paper 10 is sandwiched between the platen roller 2 and the thermal head H. Also, the load detection type sensor 7 of the paper guide 5 is pressed down by a pressing force of the platen roller 2 and the self-weight of the recording paper 10 and detects an ON state (see FIG. 4A).

Next, the platen roller 2 is rotated by a rotation drive force of the motor M transmitted to the platen roller 2 through the driven gear 2B and the gear transmission mechanism G, the recording paper 10 is transported between the platen roller 2 and the thermal head H supported by the head supporting member 3, and the thermal head H performs printing and recording on the recording paper 10.

On the other hand, when the platen roller 2 is to be completely attached to the concave surfaces 1*b* and 1*b* of the side wall portions 1*a* and 1*a* of the printer main body through pressing under a state where the recording paper 10 does not exist on the load detection type sensor 7, as the platen roller 2 is pressed, the outer periphery of the platen roller 2 gets closer to the protrusion portion 7*a* of the load detection type sensor 7. Then, the platen roller 2 is completely attached to the concave surfaces 1*b* and 1*b* of the side wall portions 1*a* and 1*a* of the printer main body and the outer peripheral surface of the platen roller 2 is stopped at a position spaced apart from the protrusion portion 7*a* of the load detection type sensor 7 by a predetermined distance (FIG. 4B). As described above, in a state in which the recording paper 10 does not exist and the platen roller 2 is completely attached to the concave surfaces 1*b* and 1*b* of the side wall portions 1*a* and 1*a* of the printer main body, the protrusion portion 7*a* of the load detection type sensor 7 cannot be pressed down and thus the load detection type sensor of the load detection type sensor 7 remains in the OFF state (see FIG. 4B).

Therefore, the load detection type sensor of the load detection type sensor 7 is set in the ON state only when the recording paper 10 surely exists on the paper guide 5 and the platen roller 2 is completely attached to the concave surfaces 1*b* and 1*b* of the side wall portions 1*a* and 1*a* of the printer main body. However, in all other cases, the load detection type sensor 7 is set in the OFF state and an error is detected.

Figure 4A:
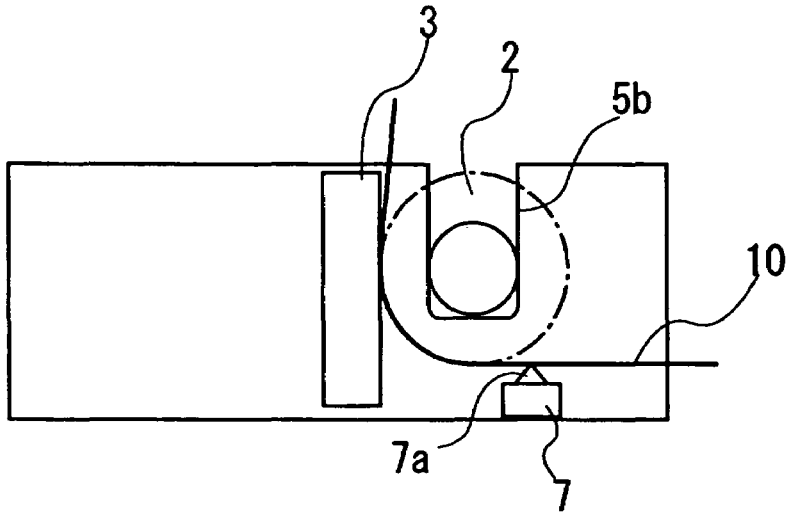
FIG. 4A-4C are a cross-sectional view showing attachment/detachment states of a platen roller and states of recording paper 10 in the thermal printer shown in FIG. 1.
Figure 4B:
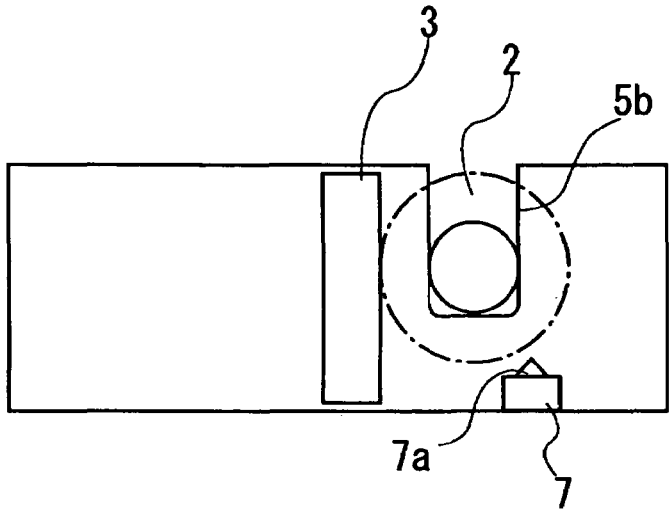
Figure 4C:
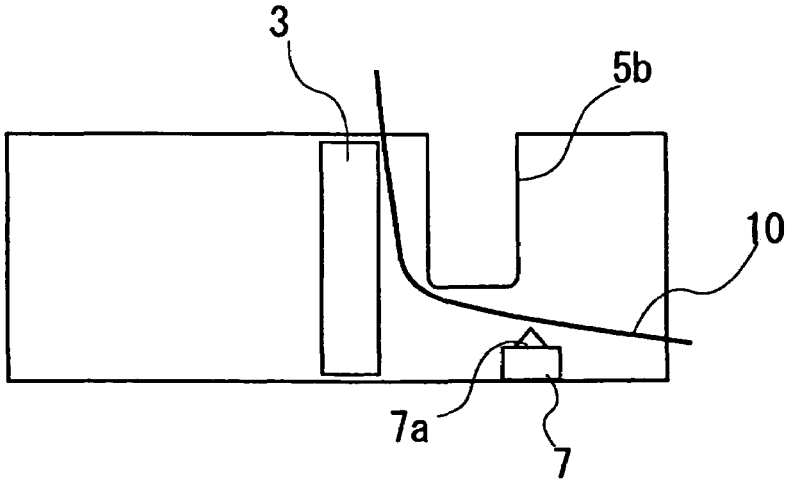

It should be noted here that when the platen roller 2 that is completely attached to the concave surfaces 1*b* and 1*b* of the side wall portions 1*a* and 1*a* as shown in FIG. 4A is to be released and detached therefrom, first, the both end surfaces of the rotation shaft 2A of the platen roller 2 attached to the concave surfaces 1*b* and 1*b* of the respective side wall portions 1*a* and 1*a* of the frame 1 are nipped between the fingers and are upwardly pulled, thereby releasing the bearings of the platen roller 2 from the concave surfaces 1*b* and 1*b* of the side wall portions 1*a* and 1*a*. Next, the bearings of the platen roller 2 abutted against the one pair of the hooks 6 curved to have a hook-like shape are further upwardly pulled. Then, after passing through the mountain-like curved portions 6*a*, the bearings of the platen roller are semi-automatically pushed up along inclined surfaces on the upper side of the mountain-like curved portions 6*a* upon receiving an urging force from the hook 6 side. In this manner, the platen roller 2 is detached from the frame 1 of the printer main body.

Figure 5:
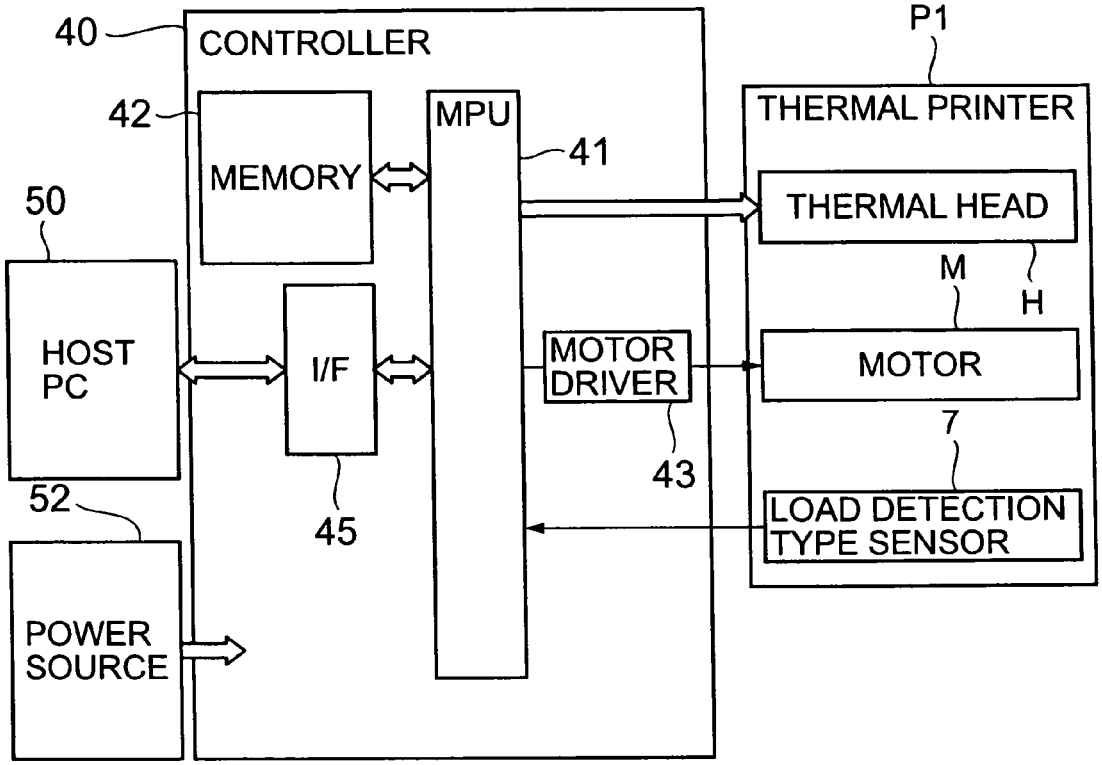
FIG. 5 is a block diagram showing the thermal printer shown in FIG. 1 and a circuit construction of a controller that controls the thermal printer.

FIG. 5 is a block diagram showing the thermal printer and a circuit configuration of a controller that controls the thermal printer.

The thermal printer 1 is connected to a control board 40 constructed as a separate body through wiring and is controlled by a control circuit on the control board 40.

In the control circuit, there are provided an MPU (Micro Processing Unit) 41 for performing the overall control of the thermal printer P1 and controlling load detection processing to be described later, a memory 42 that provides a working memory space for the MPU 41 and stores print data and the like, a motor driver 43 that supplies power to the motor M to drive the motor M based on an instruction from the MPU 41, a load detection type sensor 25 that is embedded in the load detection type sensor 7 and judges whether or not the current state is the ON state by detecting a load value, the load value being represented as a total sum of the weight of the recording paper 10 and the pressing force with which the platen roller 2 presses the recording paper 10 under a state where the platen roller 2 is completely attached to the concave surfaces 1*b* and 1*b* of the side wall portions 1*a* and 1*a*, an interface 45 that performs data input/output with a host computer 50 and the like of a main body apparatus to which the thermal printer 1 is mounted, and the like. An output from the load detection type sensor 25 is inputted into the MPU 41.

It should be noted here that power is supplied from an external power-supply unit 52. Further, the motor M is composed of a stepping motor, for instance. By inputting pulse signals to input terminals in respective phases of the motor driver 43 in order, a switch transistor connecting the winding of the motor M to a power source terminal is turned on and the winding is set in a conductive state. As a result, a drive shaft makes rotation by a predetermined angle at a time.

With this construction, when the load detection type sensor 7 is set in the ON state, the MPU 41 transmits a rotation start signal to the motor driver 43 and transmits print information and the like to a not-shown print drive circuit. As a result, the thermal head H is driven and print processing is started.

Figure 6:
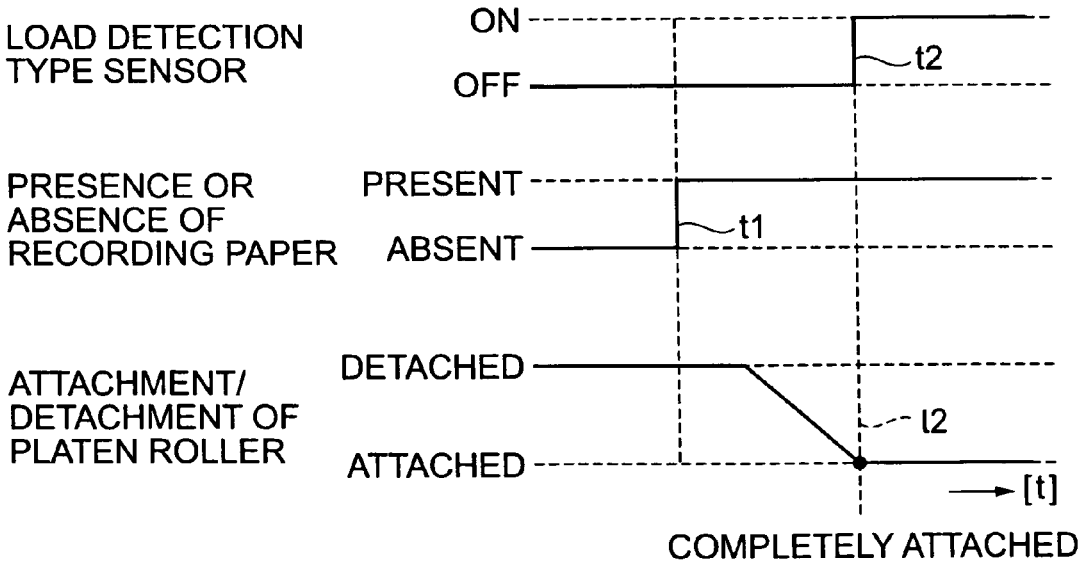
FIG. 6 is a time chart showing an example of contents of load detection processing of the thermal printer of the first embodiment.

Next, a relationship among the detection state of the load detection type sensor, the presence or absence of the recording paper, and the attachment/detachment state of the platen roller in the thermal printer will be described with reference to FIG. 6. In FIG. 6, the horizontal axis is set as a time axis (t) and the vertical axis is set so as to indicate each of the ON/OFF state of the load detection type sensor 25, the presence or absence of the recording paper, and the attachment/detachment state of the platen roller.

As shown in FIG. 6, under a state where the platen roller 2 is detached, the load detection type sensor 25 of the load detection type sensor 7 is set in the OFF state. When the recording paper 10 is pulled out from roll paper and is placed on the upper surface of the paper guide 5, a state where the recording paper 10 does not exist is changed into a state where the recording paper 10 exists (t1).

As the platen roller 2 is pressed for attachment to the concave surfaces 1*b* and 1*b* of the side wall portions 1*a* and 1*a* of the printer main body, the recording paper 10 is moved downward while being pressed by the lowermost end of the outer periphery of the platen roller 2. Under this state, however, the load detection type sensor of the load detection type sensor 7 remains in the OFF state. Following this, when the platen roller 2 is completely attached to the concave surfaces 1*b* and 1*b* of the side wall portions 1*a* and 1*a*, the protrusion portion 7*a* of the load detection type sensor 7 is pressed downward by a predetermined stroke and the load detection type sensor 7 is set into the ON state (t2). As a result, the detection of the presence or absence of the recording paper 10 and the detection of the attachment/detachment state of the platen roller 2 are started. Then, the load detection type sensor of the load detection type sensor 7 maintains the ON state until the platen roller 2 is released from the concave surfaces 1*b* and 1*b* of the side wall portions 1*a* and 1*a* again. In this way, the ON state is detected by the load detection type sensor 7 only when the platen roller 2 is completely attached to the concave surfaces 1*b* and 1*b* of the side wall portions 1*a* and 1*a* and the recording paper 10 is surely placed on the upper surface of the paper guide 5.

Figure 7:
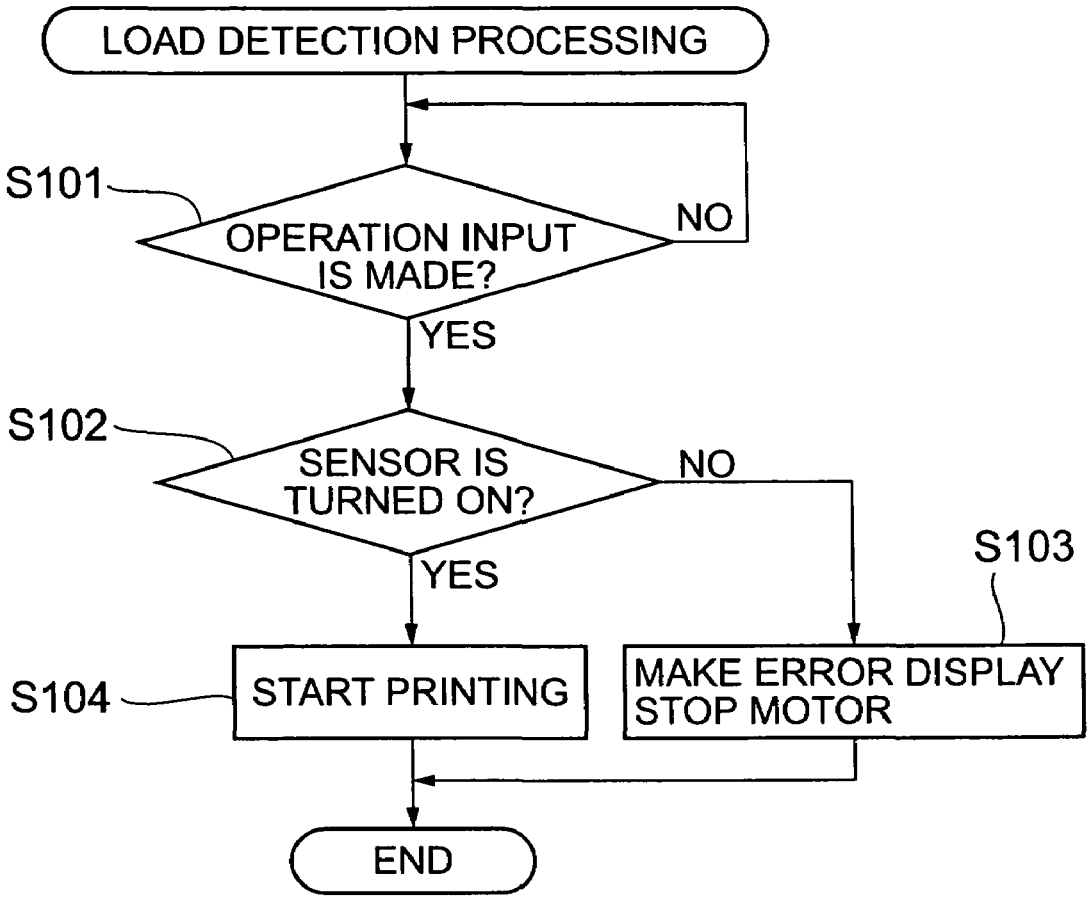
FIG. 7 is a flowchart showing a procedure of the load detection processing performed by a control circuit of the thermal printer of this embodiment.

Next, the load detection processing performed by the control circuit of the thermal printer of this embodiment will be described in detail with reference to a flowchart. FIG. 7 is a flowchart mainly showing a procedure of the load detection processing performed by the MPU 41 and the load detection type sensor 25 of the control circuit. This load detection processing is processing for detecting the presence or absence of the recording paper and the attachment/detachment state of the platen roller with reliability with reference to a detection result of the load detection type sensor 25 of the load detection type sensor 7. Note that in the following description, it is assumed that concurrently with the turning on of the power source 52, the MPU 41 is set into a state where the MPU 41 is capable of receiving a detection signal from the load detection type sensor 25 of the mechanical load detection type sensor 7 at all times and is waiting for this interrupt signal.

First, the MPU 41 judges whether a predetermined input operation is performed by a user through a not-shown operation input portion (step S101). When it is judged in step S101 that the predetermined input operation is made by the user, the processing proceeds to step S102 in which the MPU 41 judges whether the load detection type sensor 25 is set in the ON state. In more detail, the MPU 41 judges whether a sensor flag in the memory 42 of the control circuit 40 is set at "1." Here, the sensor flag is a flag that is set at "1" in a predetermined recording area in the memory 42 by the MPU 41 when a detection signal indicating that the current state is the ON state is received from the load detection type sensor 25 of the mechanical load detection type sensor 7. When the load detection type sensor 25 is set in the OFF state, that is, when the load detection type sensor 25 stops transmitting the detection signal indicating that the current state is the ON state, this sensor flag is set at "0".

When it is judged in step S102 that the load detection type sensor 25 is set in the OFF state, the MPU 41 makes an error display on a not-shown display portion, such as an LED, without delay so that the processing does not advance to the next operation, and transmits a drive stop signal to the motor driver 43, thereby performing control to stop the motor M and prohibit the motor M from making rotation (step S103). Then, this load detection processing is ended. On the other hand, when it is judged in step S102 that the load detection type sensor 25 is set in the ON state, the MPU 41 judges that the current state is a state where the recording paper 10 exists on the paper guide 5 and the platen roller 2 is completely attached to the concave surfaces 1*b* and 1*b* of the side wall portions 1*a* and 1*a* of the printer main body. Then, the MPU 41 transmits a drive start signal to the motor driver 43 to rotate the motor M and transmits print data containing a print start signal, print information, and the like to the thermal head H to thereby start print processing (step S104). Then, this load detection processing is ended.

With this construction, the load detection type sensor 25 is set into the ON state only when the recording paper 10 is placed on the paper guide 5 of the printer main body and the platen roller 2 is securely attached to the concave surfaces 1*b* and 1*b* of the side wall portions 1*a* and 1*a* of the printer main body. Also, the load detection type sensor 25 maintains the OFF state in a state, for instance, where the recording paper 10 is not placed, a state where the recording paper 10 is placed but is significantly misaligned or warped, or a state where not both of the end portions 2C and 2D of the rotation shaft 2A of the platen roller 2 are securely attached to the concave surfaces 1*b* and 1*b* of the side wall portions 1*a* and 1*a*, for example, when only one of the end portions of the platen roller 2 is attached thereto.

With the thermal printer of the first embodiment constructed in the manner described above, the detection of the attachment/detachment state of the platen roller 2 as well as the detection of the presence or absence of the recording paper 10 can be performed using the load detection type sensor 25, so that it becomes possible to reliably detect whether the current state is a state in which printing can be performed, by using only one sensor. Therefore, the number of components can be suppressed to simplify the control mechanism. Also, it is possible to use the already-existing load detection sensor 25 without newly adding a high-priced sensor, so that it becomes possible to enhance detection accuracy while preventing an increase in costs and to provide a thermal printer at a very low price.

Also, the rectangular attachment hole 5*c* is formed in substantially the center of the upper surface of the paper guide 5 and the load detection type sensor 25 is attached inside this attachment hole 5*c*. In addition, the recording paper is set in a state where the recording paper is present on the upper surface of the paper guide regardless of which paper setting system is adopted. As a result, it becomes possible to provide a thermal printer having a simple structure that can be applied to any paper setting systems merely by changing the paper guide.

Further, the load detection type sensor of the load detection type sensor 7 is set into the ON state only when the recording paper 10 surely exists on the paper guide 5 and the platen roller 2 is completely attached to the concave surfaces 1*b* and 1*b* of the side wall portions 1*a* and 1*a* of the printer main body. In all other cases, the load detection type sensor is set in the OFF state and an error is detected. As a result, it becomes possible to detect with reliability a state where it is possible to perform precise printing.

Accordingly, it becomes possible to prevent a situation where print data is lost because print processing is started under a state where precise printing is impossible and the head heating element is heated and controlled in accordance with the print data. Also, it becomes possible to prevent a situation where printing is started under a state where the platen roller is not securely attached to the frame of the printer main body and therefore heat is not properly conducted from the head heating element to the recording paper, with the result that the head heating element is heated to a high temperature and is decreased in durability. Further, it becomes possible to prevent a situation where the platen roller is pressed against the thermal head under a state where recording paper is not set and therefore the platen roller is directly heated and is significantly damaged.

[Second Embodiment]

A thermal printer according to a second embodiment of the present invention is the same in construction and operation as the thermal printer of the first embodiment except that the hooks 6 described in the first embodiment are replaced with a lever 21 integrated with an actuation surface of a cam and that a platen moving member 22 is provided between the thermal head H and the platen roller 2 and those are integrated as a unit. That is, in the first embodiment, with the hooks 6 that operate in the aforementioned manner, the platen roller 2 is easily attached or detached with respect to the concave surfaces 1*b* and 1*b* of the side wall portions 1*a* and 1*a* of the printer main body by directly nipping the both end surfaces of the rotation shaft 2A of the platen roller between the user's fingers and pushing down or pulling up the platen roller. In this second embodiment, however, by pivotally moving the lever 21 integrated with the actuation surface of the cam about the rotation shaft of the platen roller, the thermal head H is moved in a direction in which it is separated away from the platen roller 2, and the platen roller 2 is moved in a direction in which it is separated away from the load detection type sensor 7. Here, the platen moving member 22 is provided between the thermal head H and the platen roller 2 and is fixed so as to form an inherent angle with the thermal head H at a fixing pin J. With this construction, when the thermal head H is moved in a direction in which it is separated from the platen roller 2, the platen moving member 22 is also pivotally moved in a counterclockwise direction about the fixing pin J by the same distance (see FIG. 9B).

Next, an attachment/detachment operation of the platen roller 2 in the thermal printer of the second embodiment will be described in more detail with reference to FIGS. 8 and 9.

Figure 8A:
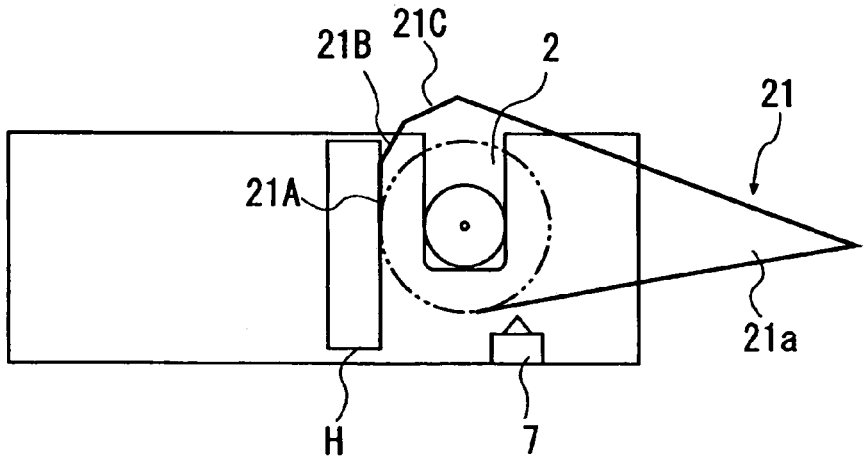
FIG. 8A-8B show an operation of a lever 21 in a thermal printer of the second embodiment.

FIG. 8 shows an operation of the lever 21 in the thermal printer of the second embodiment. As shown in FIG. 8, first, when an operation portion 21*a* of the lever 21 integrated with the platen roller 2 is pivotally moved in a clockwise direction about the rotation shaft of the platen roller 2, the platen roller 2 is set in a state where the platen roller 2 is completely attached to the concave surfaces 1*b* and 1*b* of the side wall portions 1*a* and 1*a* of the printer main body (FIG. 8A). Under this state, like in the first embodiment, the platen roller 2 is pressed against the thermal head H and the outer peripheral surface of the platen roller 2 is fixed at a position spaced apart from the protrusion portion 7*a* of the load detection type sensor 7 by a predetermined distance.

Figure 8B:
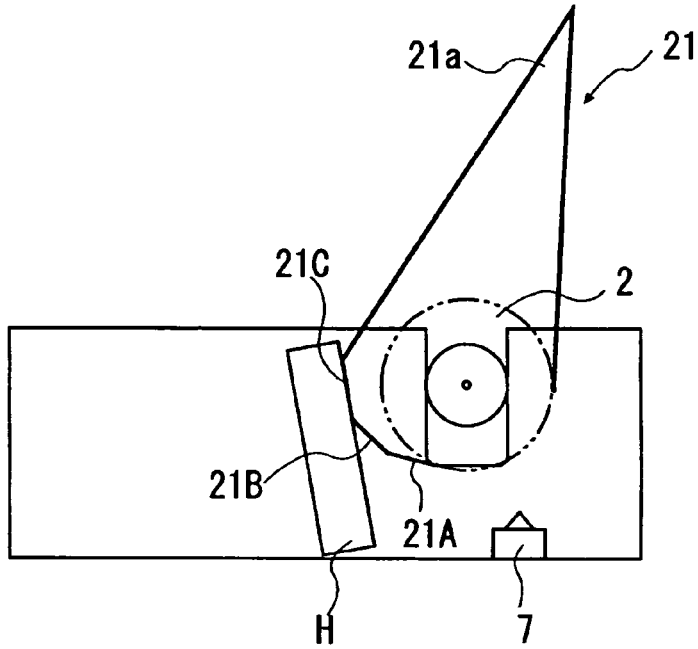

Next, when the operation portion 21*a* of the lever 21 is pivotally moved in a counterclockwise direction, actuation surfaces 21A and 21B of the lever 21 are abutted against a surface of the thermal head H in order and are pivotally moved while leftwardly pressing the thermal head H. At the same time, the end portions of the platen roller 2 are upwardly moved along substantially U-letter-shaped grooves of the concave surfaces 1*b* and 1*b* of the side wall portions 1*a* and 1*a*. Then, the operation portion 21*a* of the lever 21 is further pivotally moved and the pivotal movement of the lever 21 is stopped at a position where the actuation surface 21C is completely abutted against the surface of the thermal head H (FIG. 8B).

With this mechanism, merely by pivotally moving the lever 21 integrated with the actuation surfaces of the cam, the outer peripheral surface of the platen roller 2 is upwardly moved from the protrusion portion 7*a* of the load detection type sensor 7 and a gap is formed into which it is possible to insert the recording paper 10.

Figure 9A:
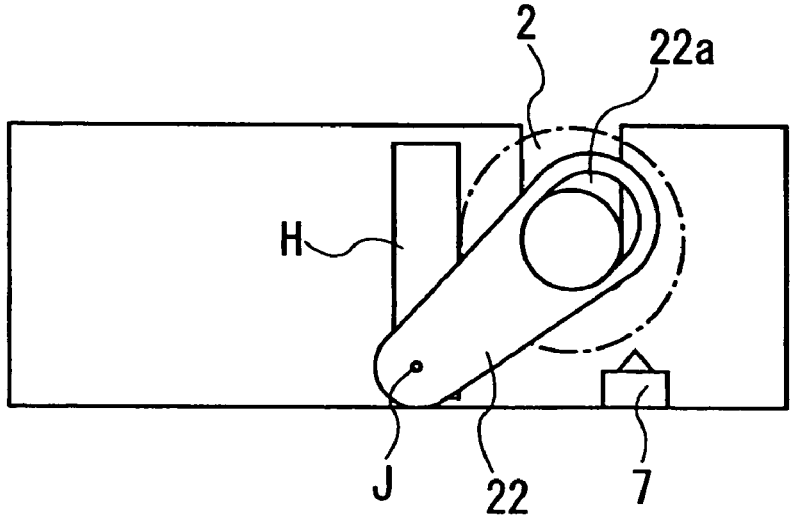
FIG. 9A-9B show an operation of a platen moving member 22 in the thermal printer of the second embodiment.
Figure 9B:
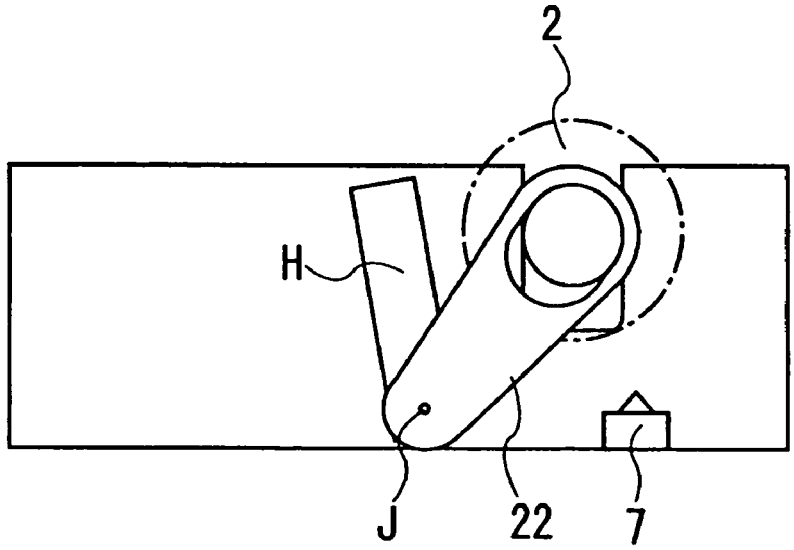

FIG. 9 shows an operation of the platen moving member 22 in the thermal printer of the second embodiment. As shown in FIG. 9*a*, the platen moving member 22 is provided between the thermal head H and the platen roller 2 and is fixed so as to form an inherent angle with the thermal head H at the fixing pin J. Also, on the right end side of the platen moving member 22, there is formed an opening portion 22*a* into which the end portion of the platen roller is inserted. With this construction, the thermal head H and the platen roller 2 are integrated with each other as a unit through the platen moving member 22. Next, an operation of the thermal head H and the platen moving member 22 interlocked with an operation of the platen roller 2 will be described.

First, when the operation portion 21*a* of the lever 21 is pivotally moved in a clockwise direction and then the platen roller 2 is completely attached to the concave surfaces 1*b* and 1*b* of the side wall portions 1*a* and 1*a* of the printer main body, there is obtained a state where the end portion of the platen roller 2 is brought into intimate contact with the lower side of an inner wall portion of the opening portion 22*a* formed on the right end side of the platen moving member 22 (FIG. 9A). Next, when the operation portion 21*a* of the lever 21 is pivotally moved in a counterclockwise direction, the end portion of the platen roller is upwardly moved inside the opening portion 22*a* in an interlocked manner with the pivotal movement of the lever 21. At the same time, the actuation surfaces 21A and 21B of the lever 21 pivotally move while leftwardly pressing the surface of the thermal head H, so that the thermal head H is pressed and is pivotally moved in a counterclockwise direction about the fixing pin J. Then, like the thermal head H, the platen moving member 22 fixed so as to form the inherent angle with the thermal head H at the fixing pin J is also pivotally moved in the counterclockwise direction about the fixing pin J by an angle that is the same as the angle by which the thermal head H is pivotally moved. After that, when the lever 21 is pivotally moved to and is stopped at a position at which its further pivotal movement is impossible, there is obtained a state where the end portion of the platen roller is brought into intimate contact with the upper side of the inner wall portion of the opening portion 22*a* (see FIG. 9B).

With this mechanism, it is possible to upwardly move the outer peripheral surface of the platen roller 2 from the protrusion portion 7*a* of the load detection type sensor 7. As a result, it becomes possible to form a gap, into which it is possible to insert the recording paper 10, without detaching the end portions of the platen roller from the concave surfaces 1*b* and 1*b* of the side wall portions 1*a* and 1*a* of the printer main body.

According to the thermal printer of the second embodiment constructed in the manner described above, it becomes possible to upwardly move the platen roller 2 from the protrusion portion 7*a* of the load detection type sensor 7 and to form a gap, into which it is possible to insert the recording paper 10, merely by pivotally moving the operation portion 21*a* of the lever 21 outwardly extending from the printer main body in the counterclockwise direction. As a result, it becomes unnecessary to detach the end portions of the platen roller from the concave surfaces 1*b* and 1*b* of the side wall portions 1*a* and 1*a* of the printer main body. In addition, it becomes possible to attach the end portions of the platen roller to the concave surfaces 1*b* and 1*b* of the side wall portions 1a and 1*a* of the printer main body with reliability by pivotally moving the operation portion 21*a* of the lever 21 in the clockwise direction.

The embodiments of the present invention have been described above. However, the present invention is not limited to them, and it is possible to make various changes without departing from the gist of the present invention. For instance, in the embodiments described above, the rectangular attachment hole 5*c* is formed in substantially the center of the upper surface of the paper guide 5, and the load detection type sensor 7 serving as a load detection type sensor is attached in this attachment hole 5*c*. However, the attachment hole 5*c* may be established in the upper surface of the paper guide 5 at a position in proximity to either of the side wall portions 1*a* and 1*a* of the frame 1. Also, in the embodiments described above, the rectangular attachment hole 5*c* is formed, but the attachment hole 5*c* may be formed in any other shape so long as it is possible to arrange the load detection type sensor 7 in the attachment hole 5*c*. For instance, a circular attachment hole may be formed.

Further, in the first embodiment, when it is judged that the load detection type sensor 25 is in the ON state, the MPU 41 transmits a drive start signal to the motor driver 43 and transmits print data to the thermal head H, thereby having the motor M make rotation and starting print processing. However, only the drive start signal may be transmitted to the motor driver 43, and only an operation for pulling in the recording paper may be performed by having the motor M make rotation. With this construction, it becomes possible to divert the thermal printer to the automatic insertion system.

According to the present invention, only in a state where the recording paper exists below the platen roller and the end portions of the platen roller are supported by the bearing portions, the sensor is brought into pressure contact with the platen roller through the recording paper and is changed to the ON state. As a result, it becomes possible to detect whether or not the current state is a printable state with reliability using only one sensor. Consequently, it becomes possible to simplify the control mechanism by suppressing the number of components. In addition, it is possible to divert the already-existing load detection sensor without newly adding an expensive sensor. As a result, it becomes possible to enhance detection accuracy without increasing costs and to provide a thermal printer at a very low price.

Also, the load detection type sensor is provided at a position where the load detection type sensor is capable of being brought into pressure contact with the platen roller through the recording paper and being changed into the ON state. As a result, it becomes possible to cope with any thermal printers regardless of their paper setting systems merely by changing some components and adding the load detection type sensor.

Also, when the moving means that moves the end portion of the platen roller in a direction in which it is released from the bearing portion and is separated from the load detection type sensor is further provided, it becomes possible to easily move the platen roller merely by pulling up the end portion of the platen roller in a direction in which it is separated from the bearing portion.

Also, it is possible to detach the shaft of the platen roller from the bearing portion with the actuation member, so that it becomes possible to construct the moving means having a simple structure and to reduce the number of components, which makes it possible to miniaturize the enclosure itself of the thermal printer. As a result, it becomes possible to reduce the volume of an information device itself equipped with the thermal printer, which contributes to miniaturization of the information device.

Also, in the case of the manual feed system or the automatic insertion system, it is possible to move the head supporting member in a direction in which it is separated from the platen roller in an interlocked manner with an operation of the lever. Therefore, it becomes possible to limit a movable range of the platen roller to a range depending on an operation range of the lever. Accordingly, it becomes possible to suppress variations in the position of the platen roller with respect to the thermal head and deviations in pressing position. Also, it is possible to lock the position of the platen roller with reliability by a click-like operation through an operation of the lever, so that it becomes possible to enhance detection accuracy.

Also, it is possible to give a range to the actuation load, so that it becomes possible to realize an operation environment of the thermal printer under which it is possible to appropriately cope with various environmental changes such as changes in the thickness of the recording paper and changes in the sectional area of the platen roller resulting from changes in the temperature. Also, the lower limit value of the actuation load is set at 0.1 N, so that it becomes possible to control the load detection type sensor so as not to detect the ON state only with the self-weight of the recording paper.

Further, ON/OFF switching of the load detection type sensor is performed with reference to a stroke distance, so that it becomes possible to easily grasp in advance the range of the thickness of printable recording paper and the range of the composition, such as the diameter and expansion coefficient, of a usable platen roller and to easily make design changes as appropriate in accordance with usage environments. Also, it is possible to give a range to the actuation load of the load detection type sensor. As a result, it becomes possible to realize operation environments for a thermal printer that can appropriately cope with various environmental changes such as the thickness of recording paper due to changes in temperature and expansion of a cross-sectional area of the platen roller.

Also, the load detection type sensor is provided at a position that is closer to the shaft of the platen roller than an intersecting position between a vertical plane contacting the outer periphery of the platen roller and a paper guide plane in a state where the platen roller is supported by the bearing portions. As a result, even if the recording paper pulled out from roll paper is misaligned or warped to some extent before being nipped between the thermal head and the platen roller, when the recording paper exists between the thermal head and the platen roller and the platen roller is attached to the main body frame, it is possible to detect the ON state.

What is claimed is:

1. A thermal printer comprising:

a main body frame having a bearing portion;

a platen roller having a shaft rotatably and detachably supported by the bearing portion of the main body frame;

a support member mounted on the main body frame for undergoing movement;

a thermal head supported by the support member for movement into and out of pressure contact with the platen roller for recording printing data on a recording medium disposed between the thermal head and the platen roller;

biasing means for biasing the thermal head into pressure contact with the platen roller;

a load detectiontype sensor mounted on the main body frame for contacting the platen roller via the recording medium to detect a preselected state of the thermal printer in which the shaft of the platen roller is supported by the bearing portion and in which the recording medium is disposed between the thermal head and the platen roller; and moving means for releasing the shaft of the platen roller from the bearing portion of the main body frame by moving the shaft of the platen roller in a direction in which the shaft is separated from the load detection-type sensor, the moving means comprising a cam abutted against the support member and a lever for pivotally moving the cam to move the support member in a direction in which the support member is separated from the platen roller.

2. A thermal printer comprising:

a main body frame having a bearing portion;

a platen roller having a shaft rotatably and detachably supported by the bearing portion of the main body frame;

a support member mounted on the main body frame for undergoing movement;

a thermal head supported by the support member for movement into and out of pressure contact with the platen roller for recording printing data on a recording medium disposed between the thermal head and the platen roller;

biasing means for biasing the thermal head into pressure contact with the platen roller;

a load detectiontype sensor mounted on the main body frame for contacting the platen roller via the recording medium to detect a preselected state of the thermal printer in which the shaft of the platen roller is supported by the bearing portion and in which the recording medium is disposed between the thermal head and the platen roller; and a guide mounted on the main body frame for guiding the recording medium;

wherein when the platen roller is supported by the bearing portion of the main body frame, the load detection-type sensor is disposed at a position closer to the shaft of the platen roller than to an intersecting position between a vertical plane contacting an outer periphery of the platen roller and a plane of the guide.

3. A thermal printer comprising:

a main body frame;

a platen roller rotatably and removably mounted in a preselected position on the main body frame;

a thermal head mounted on the main body frame for movement into and out of pressure contact with the platen roller during a printing operation and while the platen roller is in the preselected position for recording printing data on a recording medium disposed between the thermal head and the platen roller;

at least one biasing member for biasing the thermal head into pressure contact with the platen roller during a printing operation;

detecting means for detecting a preselected state of the thermal printer in which the platen roller is in the preselected position and in which the recording medium is disposed between the platen roller and the thermal head by contacting the platen roller through the recording medium, the detecting means comprising a load detectiontype sensor mounted on the main body frame for detecting a load applied thereto upon contact with the platen roller through the recording medium; and moving means for moving the platen roller from the preselected position in a direction away from the load detection-type sensor, the moving means comprising a lever connected to the platen roller, the lever having a cam portion for separating the thermal head from the platen roller when the lever moves the platen roller from the preselected position.

* * * * *